US005937559A

United States Patent [19]

Jennen

[11] Patent Number: 5,937,559

[45] Date of Patent: Aug. 17, 1999

[54] AUTO STAND FOR GUNS

[76] Inventor: Rick J Jennen, 2406 Hwy. 124, Russellville, Ark. 72801

[21] Appl. No.: 08/908,417

[22] Filed: Aug. 7, 1997

[51] Int. Cl.[6] ..... F41A 23/16

[52] U.S. Cl. ..... 42/94; 42/99; 89/37.04; 211/64

[58] Field of Search ..... 42/94, 99; 211/64; 89/37.04

[56] References Cited

U.S. PATENT DOCUMENTS

| | | | |
|---|---|---|---|
| 3,343,411 | 9/1967 | Lee | 89/37.04 |
| 3,405,377 | 10/1968 | Pierce | 206/378 |
| 3,464,134 | 9/1969 | Franklin | 40/621 |
| 3,566,526 | 3/1971 | Violette | 211/64 |
| 4,107,863 | 8/1978 | Musgrave | 42/90 |
| 4,120,109 | 10/1978 | Musgrave | 42/90 |
| 4,936,038 | 6/1990 | Johnson et al. | 211/64 |
| 5,067,268 | 11/1991 | Ransom | 42/94 |

*Primary Examiner*—Stephen M. Johnson

[57] ABSTRACT

This invention is directed to an auto stand A for supporting a gun G in an unassisted fashion. A magnet 1 located within auto stand A attaches to the lower portion of the handle to provide the needed support.

2 Claims, 5 Drawing Sheets

AUTO STAND FOR GUNS

FIELD OF THE INVENTION

This invention directed to an auto stand for firearms holds a firearm in an upright position. Such an auto gun stand is useful in many situations that permit the firearm to be supported independently leaving the users hands free.

BRIEF DESCRIPTION OF THE DRAWINGS

The invention is described in greater detail hereinafter by reference to the accompanying drawings, wherein.

DETAILED DESCRIPTION OF THE INVENTION

The auto stand A will hold a gun or guns in the upright position without any outside added support mechanism. This is useful to display the gun for show or to hold the gun for cleaning or repairing the gun. The auto stand A may also be used to steady one's hand while firing the gun G. Because of the design of the auto stand A, one stand can be used to support a variety of different handguns.

Figure 1:
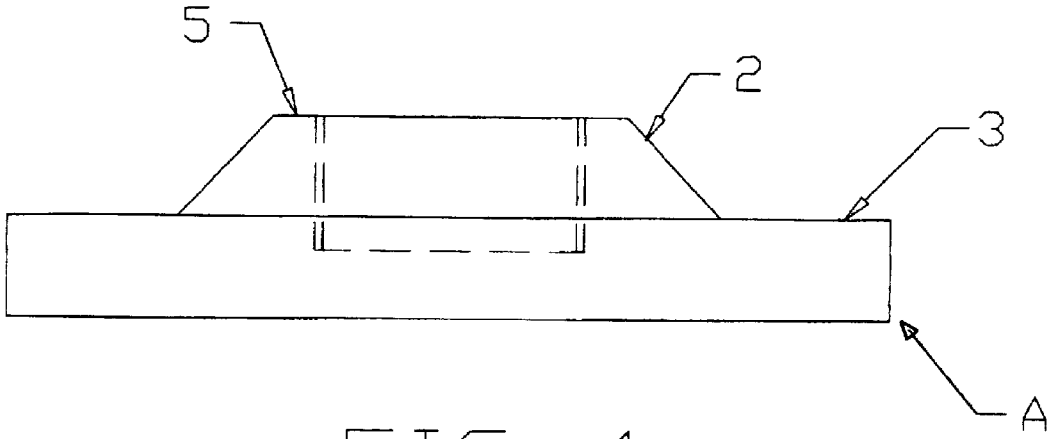
FIG. 1 is a side view of the auto stand.
Figure 2:
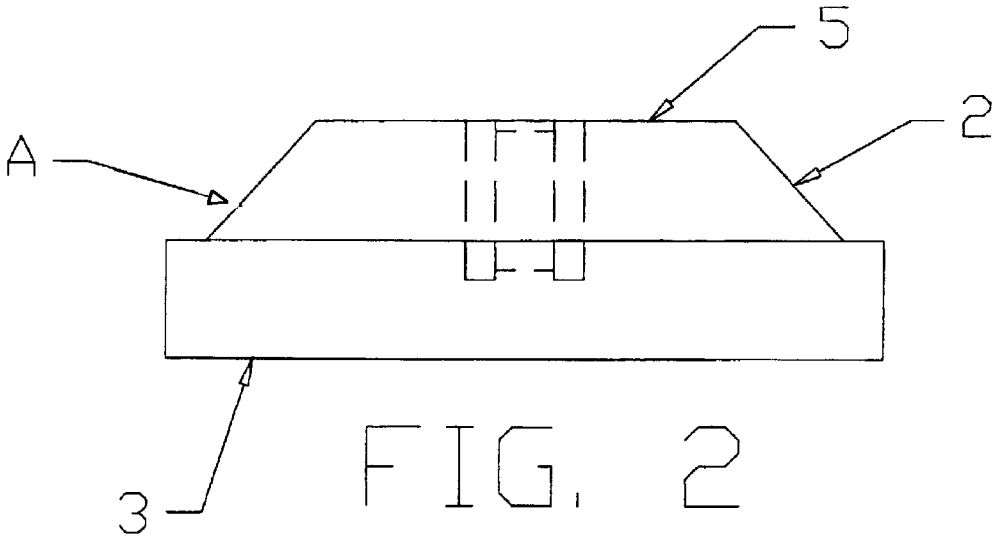
FIG. 2 is a front view of the auto stand.
Figure 3:
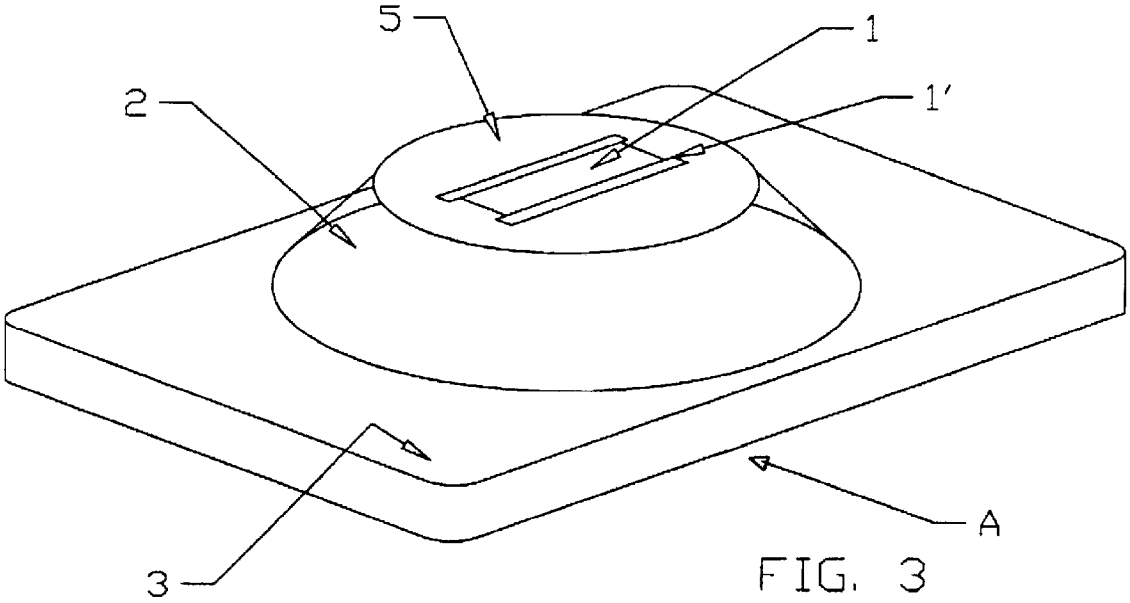
FIG. 3 is an overall view of the auto stand.
Figure 4:
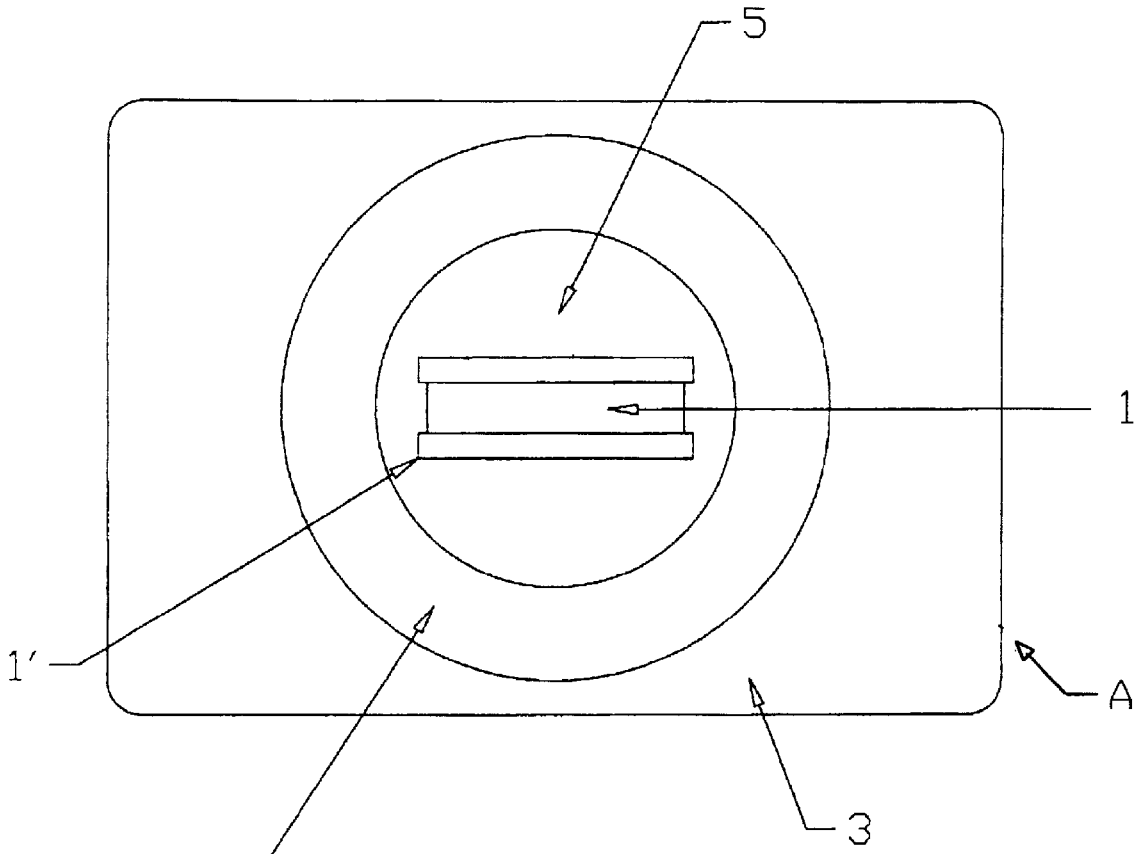
FIG. 4 is a top view of the auto stand.
Figure 5:
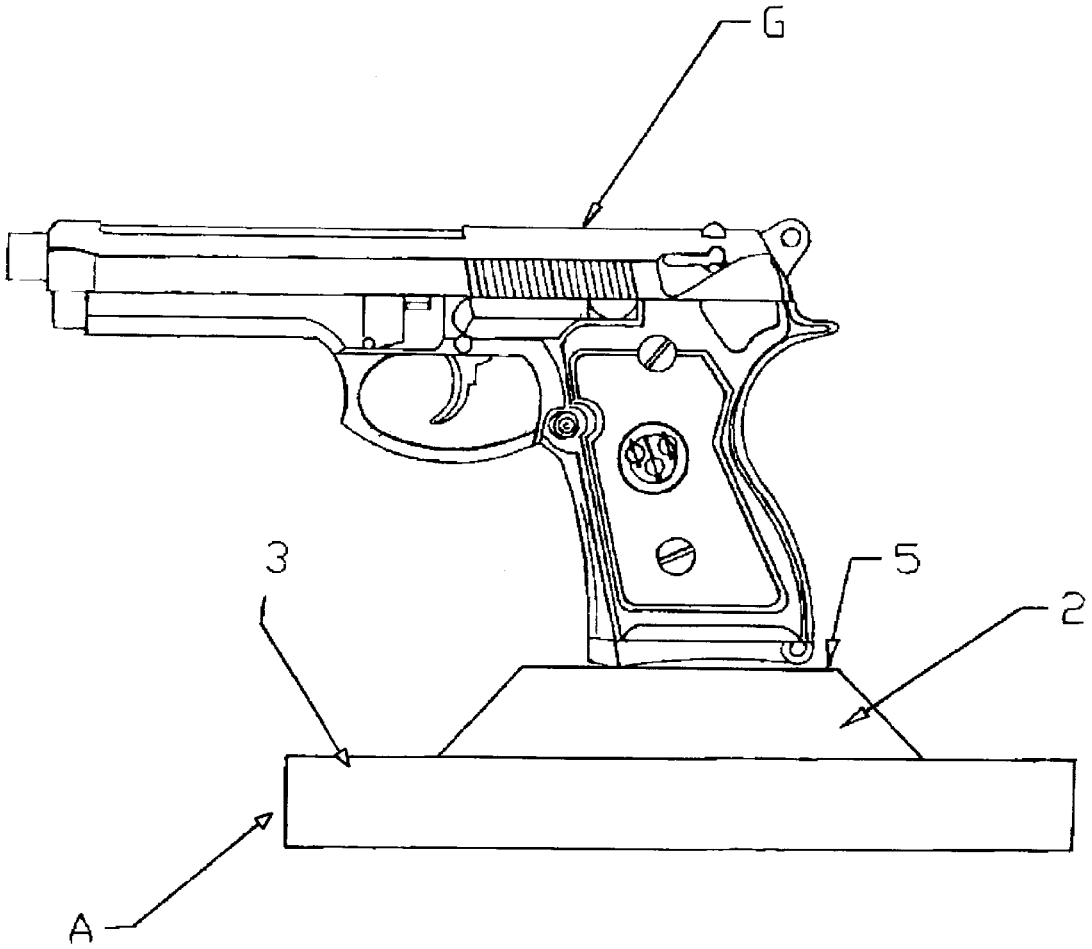
FIG. 5 is a view of the auto stand in combination with a semi-automatic pistol. It also shows how the pistol will sit on the auto stand.
Figure 6:
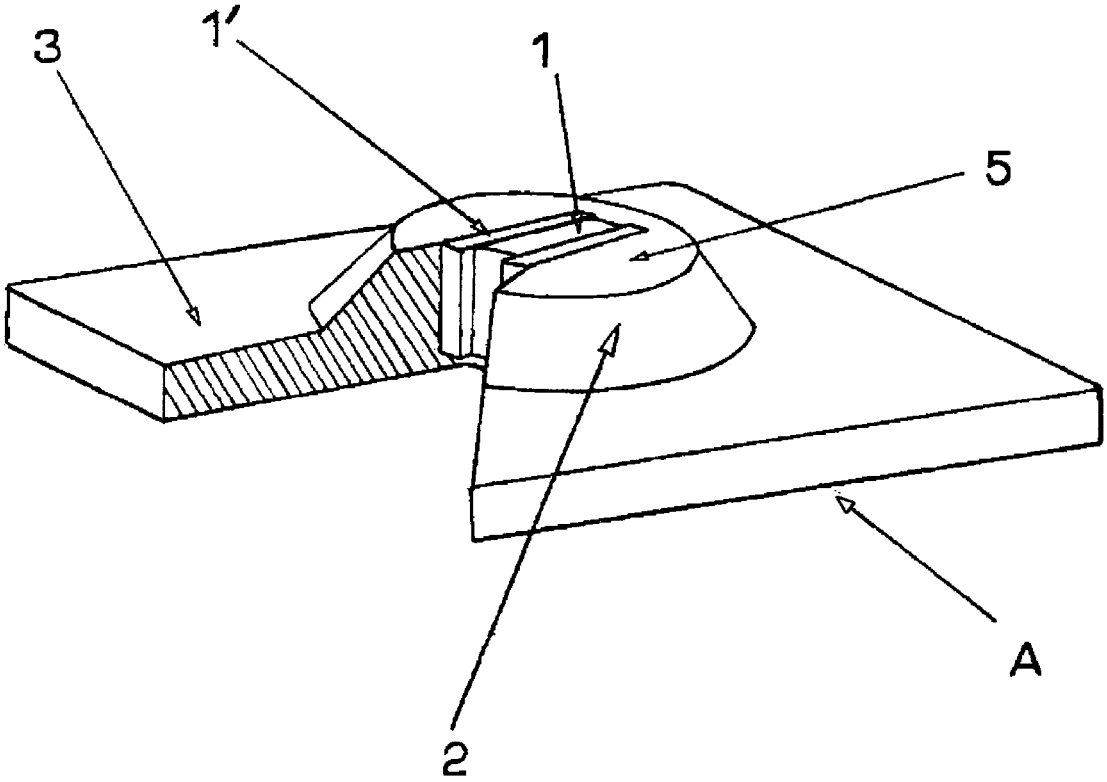
FIG. 6 is a cut-away view of the auto stand.

Auto stand A includes a base member 3 that includes a rectangular block with flat upper and lower surfaces to support the rest of the stand as well as the associated gun on a surface. A frusta-conical member 2 is attached above and supported by base member 3. The frusta-conical member 2 is responsible for holding within and supporting magnet 1 as well as metal plates 1' located on either side of magnet 1 (see FIGS. 4 and 6). The metal plates 1' on either side of magnet 1 are 1" by 1 ¾" with a thickness of ⅛". The magnet 1 is located toward the center of the auto stand A. The frusta-conical member 2 has a flat upper surface 5 upon which the gun G rests. The materials that make up base member 3 and frusta-conical member 2 of the auto stand A can be selected from the group of resin, stone, concrete, carbon, plastic, wood, or any non-ferrous material. These members can be painted, dyed, stained, and/or polished for the desired aesthetic effect. These members can be made of different shapes and styles as needed for each particular display or usage.

The auto stand A functions as follows. The handle of the pistol or gun G is placed over the magnet 1 located toward the middle of the auto stand. Since the handle of most conventional guns is made of a metal material, the magnet 1 will attached to the handle and hold the gun in an upright position. Guns that have a metal clip with a flat bottom at the lower portion of the handle will fasten to the magnet of the auto stand without alteration. Guns that do not have a flat bottom can be altered by adding a metal plate to the clip of the gun. The magnet 1 will use this clip to attach the gun to the auto stand A.

What is claimed is:

1. An auto stand for supporting a gun comprising:

a rectangular base member with flat upper and lower surfaces, a frusta-conical member attached to the flat upper surface of the rectangular base member, a magnet centrally located within the frusta-conical member and having a flat metal plate located on either side of the magnet, said frusta-conical member having a flat upper surface, said gun resting on the flat upper surface of the frusta-conical member, said gun having a handle with a lower portion, the lower portion of the handle is at least part metallic wherein the magnet attracts the metallic lower portion of the handle to attach the gun to the auto stand.

2. An auto stand for supporting a gun as claimed in claim 1 wherein the base member and the frusta-conical member are made of a material selected from the group consisting of resin, concrete, plastic, and wood.

* * * * *